US005695082A

United States Patent [19]

Rainwater

[11] Patent Number: 5,695,082

[45] Date of Patent: Dec. 9, 1997

[54] CRANE HAVING A READILY REMOVABLE OUTER BOOM SECTION

[75] Inventor: Larry B. Rainwater, Shawnee Mission, Kans.

[73] Assignee: Pioneer Engineering, Grandview, Mo.

[21] Appl. No.: 629,168

[22] Filed: Apr. 8, 1996

[51] Int. Cl.[6] ..... B66C 23/693

[52] U.S. Cl. ..... 212/177; 212/349

[58] Field of Search ..... 212/349, 177, 212/348, 350

[56] References Cited

U.S. PATENT DOCUMENTS

| | | | |
|---|---|---|---|
| 3,259,251 | 7/1966 | Stauffer | 212/349 |
| 3,523,336 | 8/1970 | Kimber | 212/349 |
| 3,736,710 | 6/1973 | Sterner | 212/349 |
| 3,804,262 | 4/1974 | Wiencek et al. | 212/349 |
| 4,011,699 | 3/1977 | Mickelson | 212/349 |
| 4,125,974 | 11/1978 | Kay et al. | 212/349 |
| 4,514,939 | 5/1985 | Rathe et al. | 212/230 |
| 4,588,347 | 5/1986 | Murta | 212/349 |
| 5,494,396 | 2/1996 | Wilson | 212/349 |

*Primary Examiner*—Thomas J. Brahan

*Attorney, Agent, or Firm*—Hovey,Williams,Timmons & Collins

[57] ABSTRACT

A crane apparatus includes an upstanding mainframe and a boom unit supported for pivoting movement on the mainframe about a horizontal axis. The boom unit includes a base boom, an outer boom section of one or more outer booms, and a fluid-actuated piston-and-cylinder assembly. A pair of space mounting walls are presented by the base boom in which a hole is defined, and the piston-and-cylinder assembly includes a proximal transverse sleeve sized for receipt between the spaced walls of the base boom in alignment with the hole. A pin is provided that is sized for receipt in the hole and the tubular sleeve for securing the piston-and-cylinder assembly to the base boom. Removal of the pin enables the outer boom section and piston-and-cylinder assembly to be removed from the base boom.

3 Claims, 7 Drawing Sheets

14
28
90
24
22
18
100
64
62
110
84
54
98
112
118
120
44
42
114
116
30
20
32
26
12
46
16
10

CRANE HAVING A READILY REMOVABLE OUTER BOOM SECTION

BACKGROUND OF THE INVENTION

1. Field of the Invention

The present invention relates generally to cranes and, more particularly, to a boom assembly for a truck-mounted crane, wherein the boom assembly includes a base boom and an extensible outer boom section readily removable from the base boom.

2. Discussion of the Prior Art

It is known to provide a truck-mounted crane having an upstanding mainframe connected to the frame of the truck, and a boom unit supported for rotation on the mainframe about a vertical axis. The boom unit typically includes a turret on which a base boom is supported for pivoting movement about a horizontal axis, and an outer boom section including one or more outer booms is telescopically received in the base boom for extending the reach of the crane.

A hydraulic piston-and-cylinder assembly extends between the turret and the base boom in the conventional construction to pivot the booms about the horizontal axis, and another piston-and-cylinder assembly is provided within the base boom for extending and retracting the outer boom section.

Truck-mounted cranes have many applications and more are being discovered with each advance in the design and construction of such apparatuses. However, with such existing constructions, there are drawbacks. For example, because of the nature of hydraulic-powered systems, it is necessary to service the piston-and-cylinder assemblies, as well as the remainder of the fluid handling system, at periodic intervals during the life of the crane. In addition, other parts of the base boom and telescopic outer boom section require occasional replacement, service, or repair.

In order to service an existing crane, it is necessary to disassemble the outer booms individually, and to remove numerous pads from the boom unit in order to obtain access to many of the internal elements that must be serviced. Such an exercise is difficult to complete in a shop, and practically impossible in the field, thus requiring that any crane to be serviced must be removed from use to receive such work. Additionally, the disassembly and reassembly of an existing boom unit is difficult, requiring both experience and patience to complete.

OBJECTS AND SUMMARY OF THE INVENTION

It is an object of the present invention to provide a cane having a readily removable outer boom section for facilitating the servicing, repair and replacement of internal parts of the boom unit so that such activity can be conducted more quickly than with conventional canes, and can be completed either in a shop or in the field.

It is another object of the invention to provide such an apparatus, wherein the piston-and-cylinder assembly within the base boom is retained on the outer boom section upon removal so that the piston-and-cylinder assembly can be removed and serviced without requiring several time-consuming disassembly steps in which numerous parts must be removed from the boom unit to obtain access to the assembly.

In accordance with these and other objects evident from the following description of a preferred embodiment of the invention, a crane apparatus is provided which includes an upstanding mainframe, and a boom unit supported for pivoting movement on the mainframe about a horizontal axis. The boom unit includes a base boom presenting a proximal end and a distal end and defining a pair of spaced mounting walls in which a hole is defined, an outer boom section telescopically received within the base boom, and a fluid-actuated piston-and-cylinder assembly presenting a proximal end and a distal end and including a transverse tubular sleeve adjacent the proximal end thereof. The sleeve is sized for receipt between the spaced walls of the base boom in alignment with the hole so that a pin can be received in the hole and the tubular sleeve for securing the piston-and-cylinder assembly to the base boom. In this manner, the pin holds the piston and cylinder assembly on the base boom, and removal of the pin enables the outer boom section and piston-and-cylinder assembly to be removed from the base boom.

By providing a construction in accordance with the present invention, numerous advantages are realized. For example, by connecting the piston-and-cylinder assembly to the base boom with a removable pin, disassembly of the piston-and-cylinder assembly, and of the outer boom section, is simplified, rendering the internal parts of the boom unit readily accessible for servicing and repair. In addition, such a construction makes it easier to replace worn out parts and enables easier service of the boom unit in the field than existing constructions.

BRIEF DESCRIPTION OF THE DRAWING FIGURES

The preferred embodiment of the invention is described in detail below with reference to the attached drawing figures, wherein:

FIG. 1 is a side-elevational view of a truck-mounted crane constructed in accordance with the preferred embodiment;

FIG. 2*a* is a fragmentary side-sectional view of a boom unit of the apparatus, illustrating the proximal end of the boom unit;

FIG. 2*b* is a fragmentary side-sectional view of the boom unit, illustrating the distal end of the boom unit;

FIG. 3 is a fragmentary side-sectional view similar to FIG. 2*a*, illustrating an outer boom section of the boom unit being disassembled from a base boom of the boom unit;

FIG. 4*a* is a top-sectional view of the proximal end of the boom unit, illustrating the outer boom section extended relative to the base boom;

FIG. 4*b* is a top-sectional view of the distal end of the boom unit;

DETAILED DESCRIPTION OF A PREFERRED EMBODIMENT

Figures 1, 5:
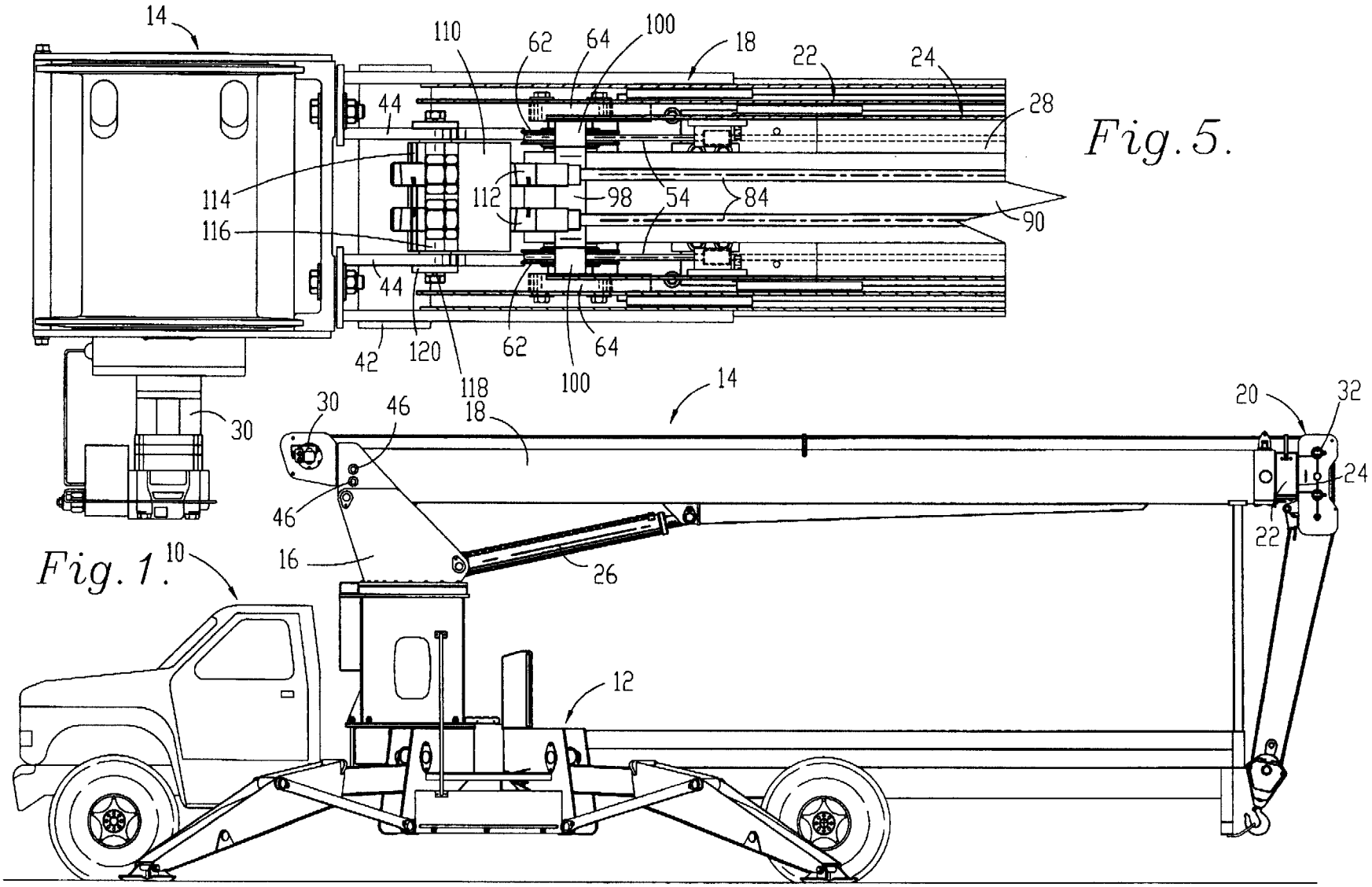
FIG. 5 is a top-sectional view of the proximal end of the boom unit, illustrating the outer boom section retracted relative to the base boom.

A truck-mounted crane constructed in accordance with the preferred embodiment of the present invention is illustrated in FIG. 1. The truck 10 is conventional, and includes an elongated frame extending between the front and rear wheels, and a cab over the front wheels.

Figure 7:
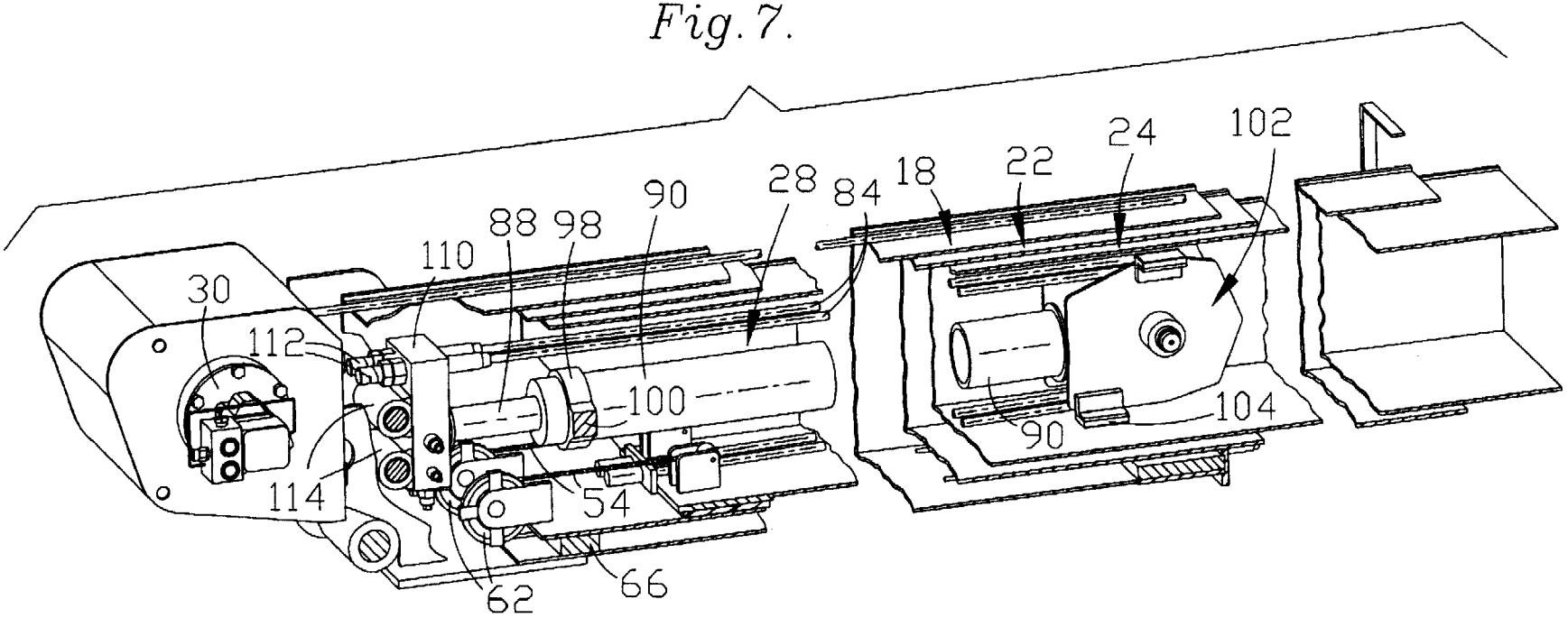
FIG. 7 is a perspective view of the boom unit, partially sectioned to illustrate the interior of the boom unit.

The crane broadly includes a mainframe 12 secured to the frame of the truck, and a boom unit 14. The boom unit includes a turret 16 supported for rotation on the mainframe about a vertical axis, a base boom 18 supported for pivotal movement on the turret about a horizontal axis, and an outer boom section 20 including a pair of outer booms 22, 24 telescopically received in the base boom. A piston-and-cylinder assembly 26 extends between the turret and the base boom for driving pivotal movement of the booms relative to the turret, and a second piston-and-cylinder assembly 28, shown in FIG. 7, is supported within the base boom and connected to the intermediate boom for driving telescopic movement of the outer booms. A winch 30 is mounted at the proximal end of the base boom and includes a line extending to the distal end of the outer boom over a pulley 32 for supporting a block from the end of the boom unit, as illustrated in FIG. 1.

Figure 2A:
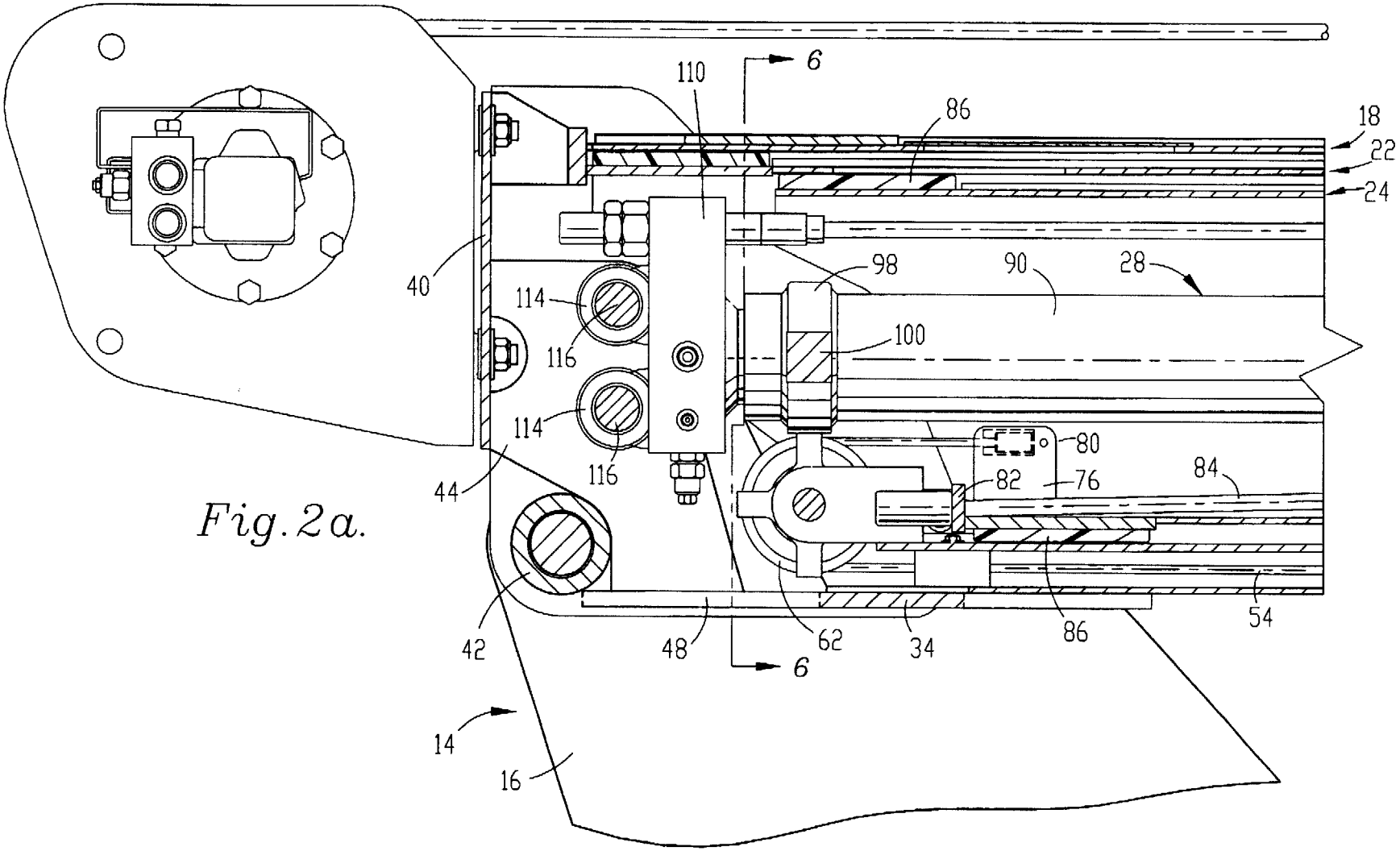
Figure 6:
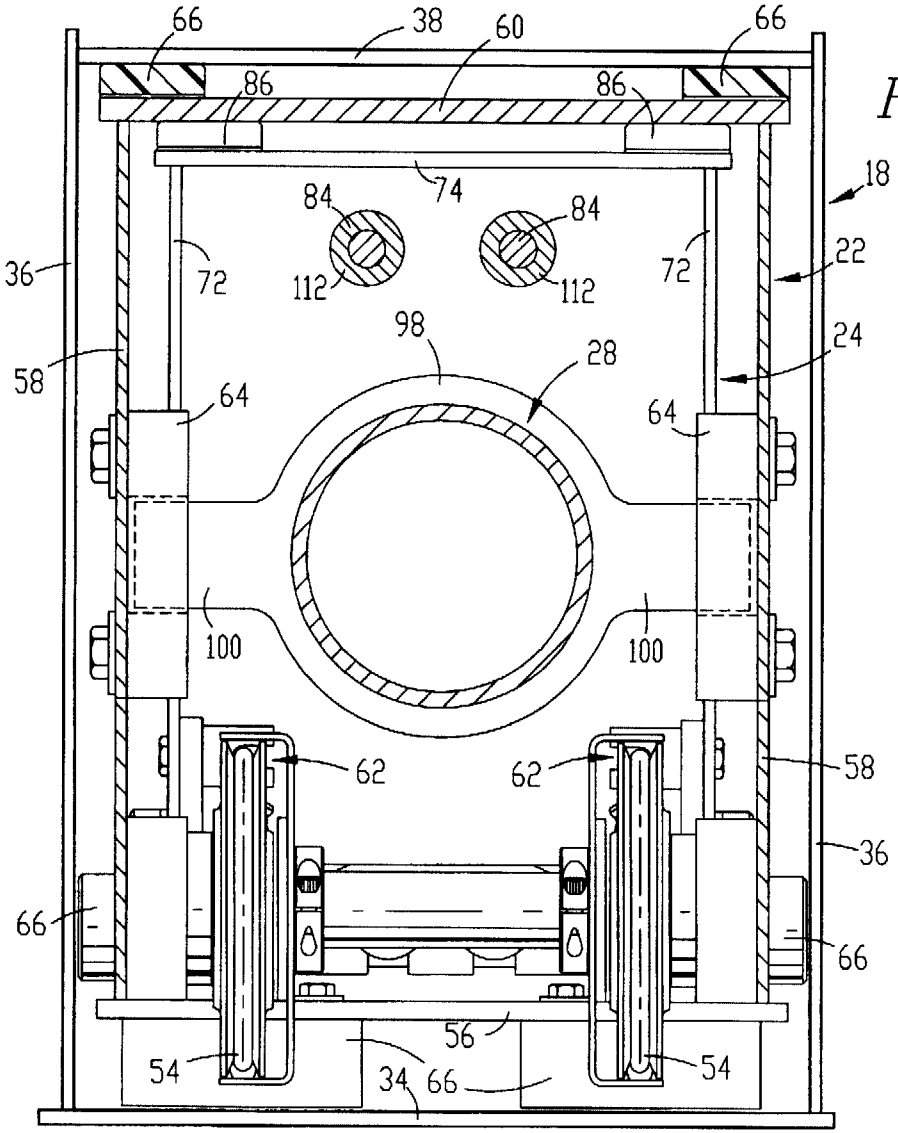
FIG. 6 is a sectional view taken along line 6—6 of FIG. 2*a;*

The base boom 18 is shown in FIG. 6, and includes a planer bottom wall 34, a pair of planer side walls 36 supported on and secured to the bottom wall, and a planer top wall 38 secured between the side walls. The walls define a hollow interior space within the base boom having a generally rectangular cross-sectional area sized for receipt of the outer boom section 20. As shown in FIG. 2*a*, the proximal end of the base boom is closed off by an end wall 40 and, as shown in FIG. 2*b*, the distal end is open for receipt of the outer boom section.

Figure 4A:
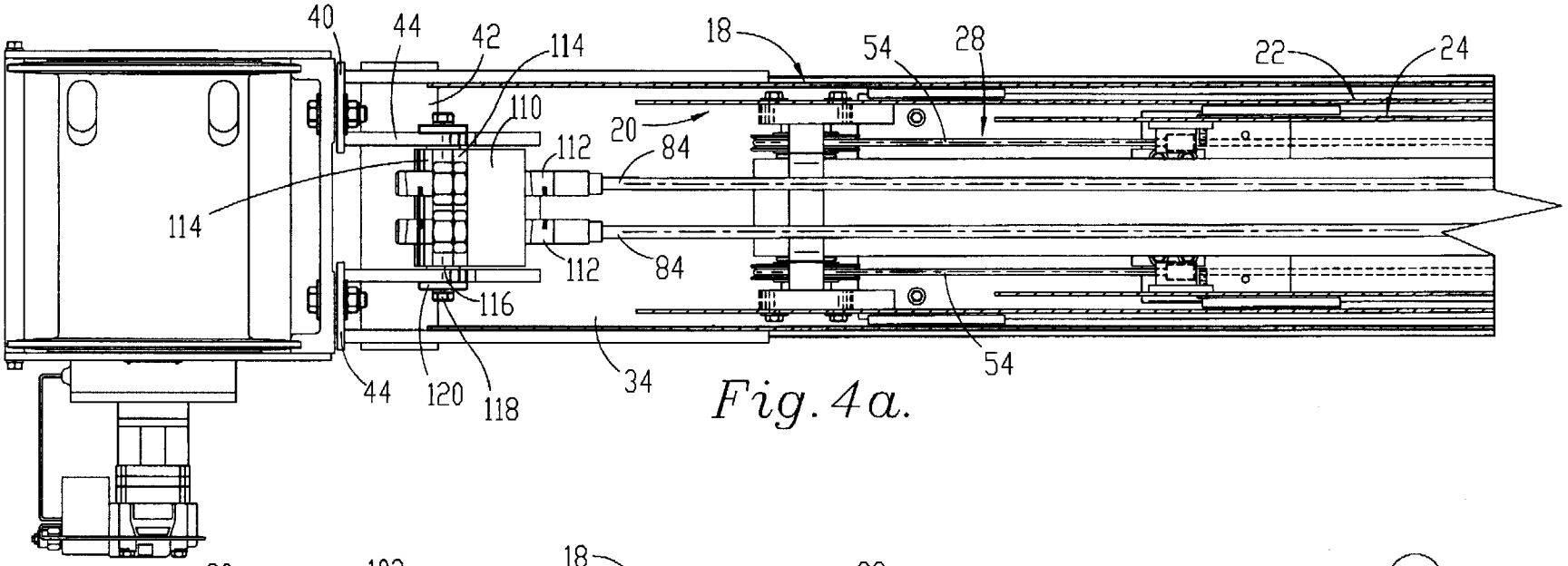
Figure 4B:
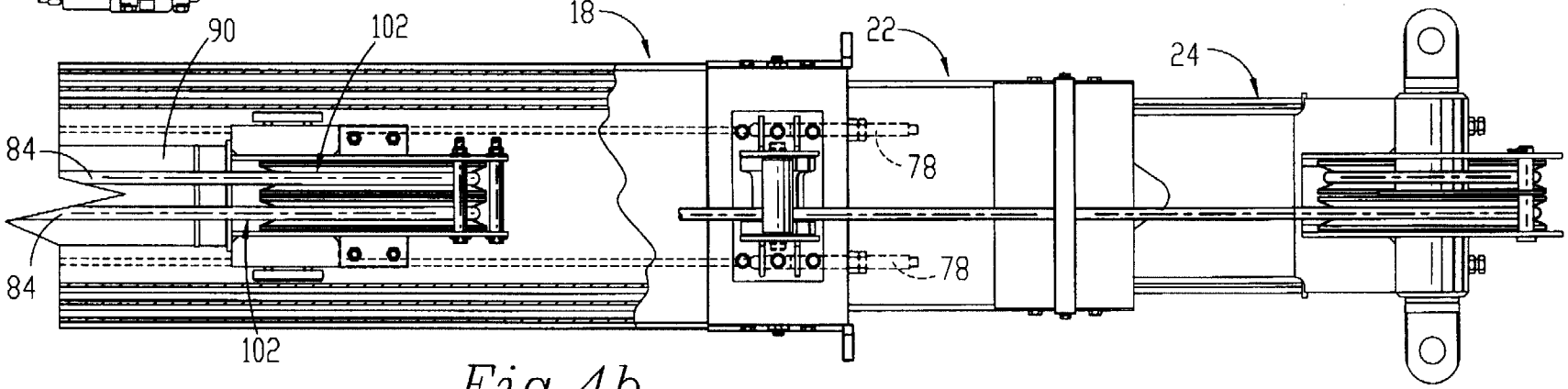

Returning to FIG. 2*a*, a tubular sleeve 42 is secured between the side walls of the base boom at the proximal end thereof in alignment with a hole extending through the side walls. The sleeve 42 defines the axis about which the booms pivot relative to the turret. As shown in FIG. 4*a*, a pair of laterally spaced mounting walls 44 are provided at the proximal end of the base boom within the interior space. The mounting walls are secured to the end and bottom walls 40, 34 of the boom, and each is disposed in a plane perpendicular to the pivot axis defined by the sleeve 42. A pair of vertically spaced holes 46 are formed in each mounting wall and in each side wall, as shown in FIG. 1, such that the two holes extend completely through the base boom and the mounting walls with one of the holes positioned directly above the other. As shown in FIG. 2*a*, the bottom wall includes an opening 48 in the vicinity of the holes to provide access to the interior space of the base boom at the proximal end thereof. In addition, this opening permits the hydraulic lines to be connected to the piston-and-cylinder assembly 28.

Figure 2B:
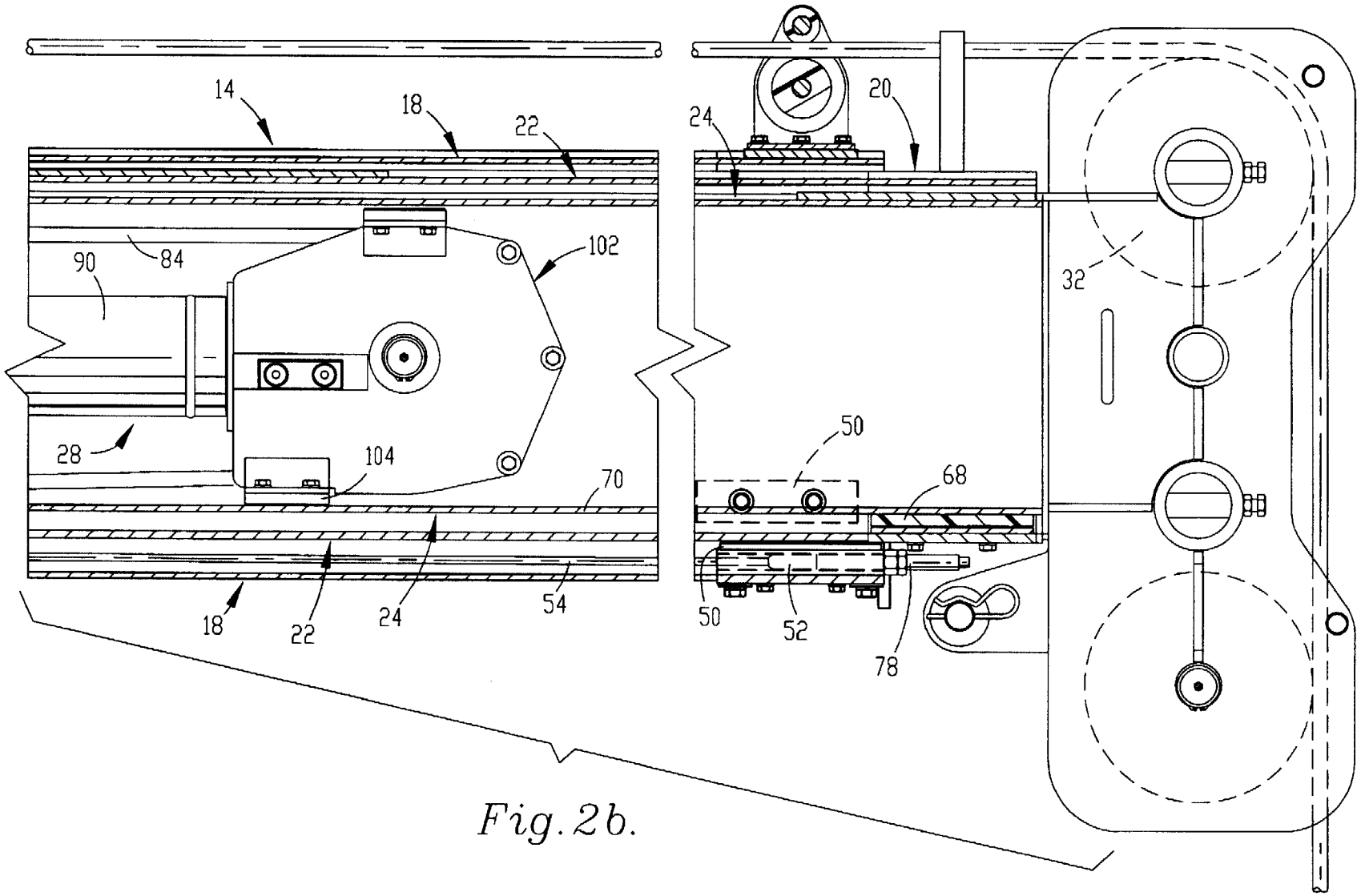

Turning to FIG. 2*b*, the base boom 18 is provided with inwardly directed rub pads 50 at the distal end of the base boom for supporting and guiding telescopic movement of the outer boom section 20. Preferably, two rub pads are provided on the bottom wall, each positioned adjacent one of the side walls, and one rub pad is provided on each side wall. In addition, a pair of blocks 52 are mounted inboard of each rub pad on the bottom wall for permitting a pair of cables 54 to be fastened to the base boom at the distal end. As discussed below, the cables 54 form part of a movement transmitting means for transmitting movement of the piston-and-cylinder assembly 28 to the outer boom 24.

As mentioned, the outer boom section 20 includes the intermediate and outer booms 22, 24 of the unit 14, wherein the intermediate boom 22 is telescopically received in the base boom 18 and the outer boom 24 is telescopically received in the intermediate boom.

The intermediate boom 22 is shown in cross section in FIG. 6, and includes a planer bottom wall 56, a pair of planer side walls 58 supported on and secured to the bottom wall, and a planer top wall 60 secured to the side walls. The walls define a hollow interior space within the intermediate boom having a generally rectangular cross-sectional area sized for receipt of the outer boom. Both ends of the intermediate boom are open so that the piston-and-cylinder assembly 28 can be received in the proximal end thereof, as shown in FIG. 2*a*, and the outer boom received in the distal end, as shown in FIG. 2*b*. Returning to FIG. 6, a pair of sheaves 62 are supported by brackets on the bottom wall of the intermediate boom, and extend from the proximal end of the boom.

A shoe 64 is secured to each side wall of the intermediate boom within the interior space at a height above the sheaves 62. These shoes 64 include laterally extending slots that are aligned with one another, and define a means for attaching the intermediate boom to the piston-and-cylinder assembly 28 so that bi-directional movement of the assembly is transmitted to the intermediate boom. Rub pads 66 are provided on the outside surfaces of the walls of the intermediate boom at the proximal end of the boom for reducing wear of the base and intermediate booms during relative telescopic movement. Similarly, as shown in FIG. 2*b*, rub pads 68 are provided on the inside surfaces of at least some of the walls of the intermediate boom at the distal end thereof for reducing wear of the intermediate and outer booms during relative telescopic movement.

The outer boom includes a planer bottom wall 70 (FIG. 2*b*), while a pair of planer side walls 72 as shown in FIG. 6, are supported on and secured to the bottom wall, and a planer top wall 74 secured to the side walls. The walls define a hollow interior space within the outer boom having a generally rectangular cross-sectional area sized for receipt of the piston-and-cylinder assembly 28. As shown in FIG. 2*a*, the proximal end of the outer boom is open so that the piston-and-cylinder assembly can be received in the interior space, and an end wall closes off the distal end and supports the pulley 32 at the end of the boom unit, as shown in FIG. 2*b*.

With reference to FIG. 2*a*, a pair of upstanding blocks 76 are secured to the bottom wall of the outer boom at the proximal end thereof and within the interior space defined by the outer boom. The blocks are spaced laterally from one another and are aligned longitudinally with the sheaves 62. Each block 76 includes a socket for receiving an end fitting of one of the cables 54, and the cables extend around the sheaves 62 and are received in the blocks 52 at the distal end of the base boom, as shown in FIG. 2*b*. Threaded end fittings 78 secure the cables 54 to the blocks and permit the cables to be easily unfastened from a position outside the boom unit. Returning to FIG. 2*a*, the blocks 76 on the outer boom are each provided with a roller 80 having a circumferential surface protruding above the block for supporting the piston-and-cylinder assembly 28 for movement relative to the outer boom.

The proximal end of the outer boom is also provided with a pair of brackets 82 that are fastened to the upper surface of the bottom wall 70. The brackets 82 are spaced laterally inward from the blocks 76, and receive the end fittings of a pair of cables 84 that, along with the cables 54, define the movement transmitting means for transmitting movement of the piston-and-cylinder assembly 28 to the outer boom 24. Rub pads 86 are also provided at the proximal end of the outer boom on the outer surfaces of the walls for reducing wear between the outer and intermediate booms during relative telescopic movement.

The piston-and-cylinder assembly 28 is illustrated in FIG. 7, and includes a piston 88 connected to the base boom and a cylinder 90 connected to the intermediate boom 22. The distal end of the piston includes a piston head 92 that is received in the cylinder, as shown schematically in FIGS. 8 and 9, and the cylinder is sealed around the piston to define two interior ends 94, 96 each separated from the other by the piston head. Returning to FIG. 7, the proximal end of the cylinder includes an outer collar 98 that is secured in place on the cylinder and presents a pair of laterally extending arms 100. The arms are received in the slots of and retained by the shoes 64 of the intermediate boom 22, as shown in FIG. 6, so that when the cylinder is extended relative to the piston, the intermediate boom 22 is extended relative to the base boom 18. Likewise, retraction of the cylinder retracts the intermediate boom relative to the base boom. It is therefore to be seen that the collar 98, arms 100 and shoes 64 cooperate to define a trunnion connection of the cylinder assembly 28 to the intermediate boom 22.

A pair of sheaves and sheave brackets 102 are supported at the distal end of the cylinder 90, as illustrated in FIG. **4*b*, and the cables 84 are trained around the sheaves and connected to the base boom 18 so that when the cylinder is extended, the sheaves 102 move outward from the base boom, forcing the cables 84 to extend the outer boom relative to the intermediate boom proportionately to the movement of the intermediate boom relative to the base boom, as shown in FIG. 4*a*. With reference to FIG. 7, upon retraction of the cylinder the sheaves 62 on the intermediate boom force the cables 54 to retract the outer boom relative to the intermediate boom proportionately to the movement of the intermediate boom relative to the base boom toward the fully retracted position of the booms shown in FIG. 5. Rub pads 104** are provided on the bottoms of the sheave brackets for supporting the distal end of the cylinder within the outer boom and for reducing wear of the brackets and the outer boom.

Figure 9:
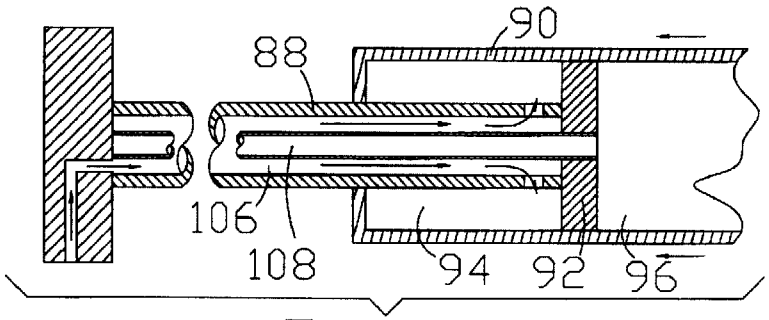
FIG. 9 is a schematic view similar to FIG. 8, illustrating the fluid flow path during retraction of the assembly.
Figure 8:
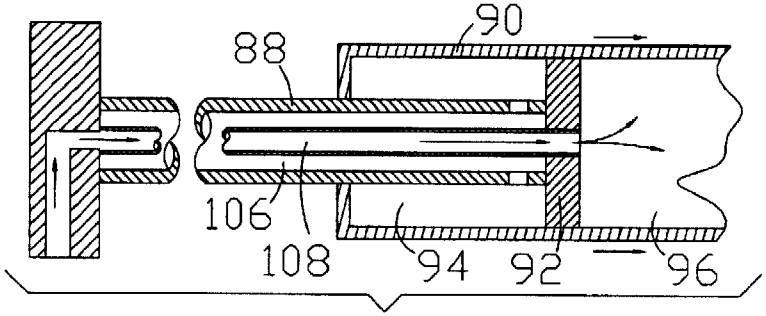
FIG. 8 is a schematic view of a piston-and-cylinder assembly forming a part of the boom unit, illustrating the fluid flow path during extension of the assembly.

As depicted in FIG. 8, the piston 88 is a double-walled tubular piston presenting a pair of axially extending fluid passages 106, 108 that are isolated from one another. One of the passages 106 communicates with the proximal interior end 94 of the cylinder through orifices provided in the outer wall of the piston adjacent the piston head. The other passage 108 in the piston communicates with the distal interior end 96 of the cylinder through an orifice extending through the piston head 92. Thus, when hydraulic fluid is transmitted under pressure to the first passage 106, as shown in FIG. 9, the cylinder is retracted, and when fluid is transmitted to the second passage 108, as shown in FIG. 8, the cylinder is extended.

A manifold block 110 is secured to the proximal end of the piston 88, as illustrated in FIG. 7, and defines fluid passages for connecting the passages of the piston to hydraulic lines connected to the block. In addition, the block 110 includes a pair of laterally spaced holes disposed above the piston-and-cylinder assembly for receiving the cables 84. Threaded end fittings 112 are preferably provided on the cables so that the cables can be secured to the block 110 by nuts. A pair of tubular sleeves 114 are welded or otherwise secured to the proximal face of the block, and the sleeves extend in a direction parallel to the pivot axis defined by the sleeve 42 and perpendicular to the longitudinal axis of the piston-and-cylinder assembly 28, as shown in FIG. **4*a*. The sleeves are spaced vertically from one another by a distance equal to the spacing between the holes in the mounting walls of the base boom, and are of a length less than the spacing between the mounting walls. Thus, the block can be secured to the base boom by positioning the sleeves 114 between the mounting walls 44 in alignment with the holes and by inserting pins 116** through the holes and sleeves.

Preferably, each pin 116 is cylindrical, including opposed axial ends within which threaded bores are tapped. Bolts 118 sized for threaded receipt in the bores are provided for securing the pins in place, and caps 120 are sandwiched between the heads of the bolts and the mounting walls for preventing the pins from shifting axially within the sleeves.

With the piston-and-cylinder assembly 28 connected to the base boom 18, actuation of the assembly carries out bi-directional telescopic movement of the intermediate boom section 22. At the same time, the two pairs of cables 54, 84 transmit movement of the cylinder and the intermediate boom to the outer boom 24, carrying out bi-directional movement of the outer boom proportionately to movement of the intermediate boom.

Figure 3:
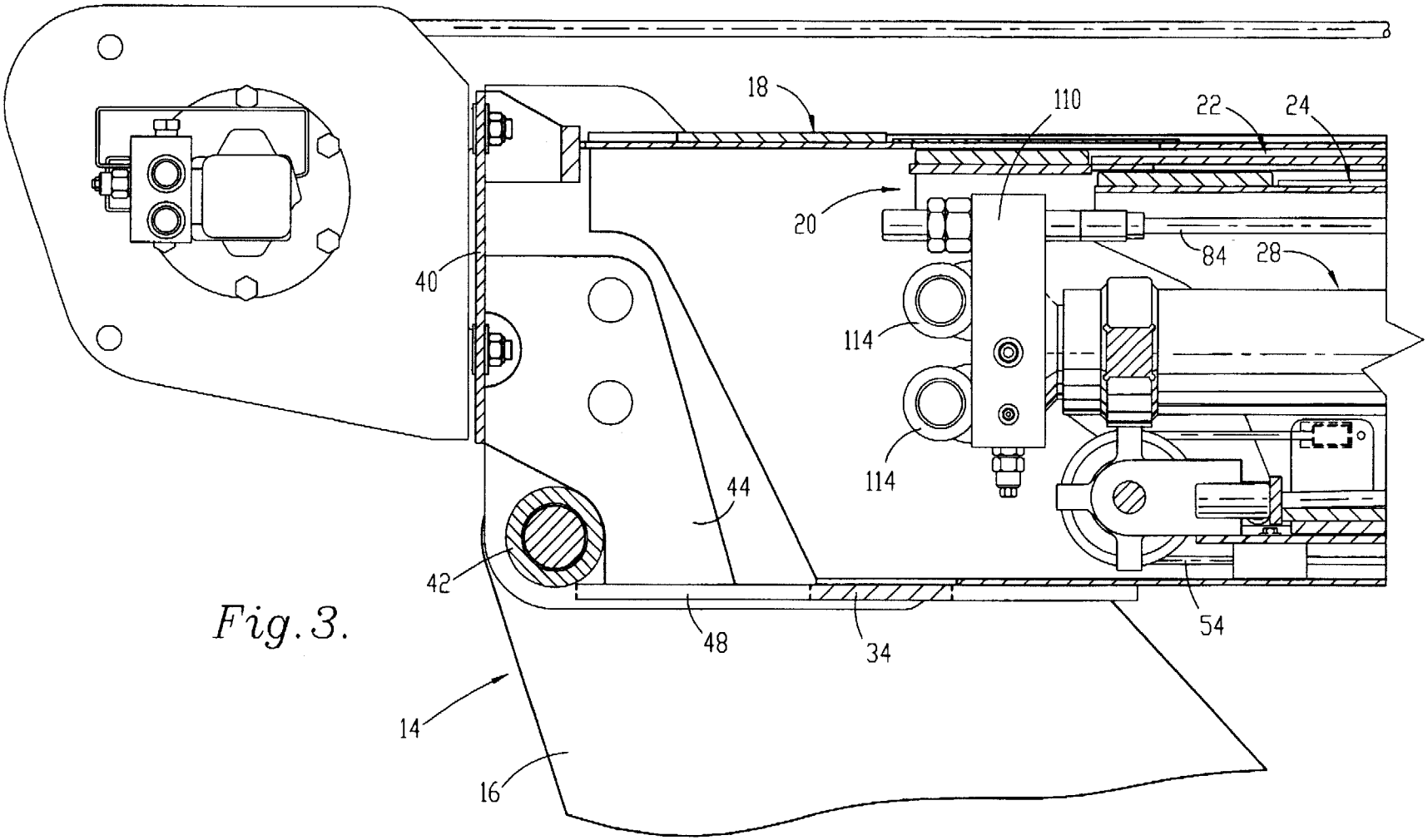

In order to remove the piston-and-cylinder assembly 28, the intermediate boom 22, the outer boom 24, and the two pairs of cables 54, 84 from the base boom, only two steps are required. Initially, the end fittings 78 of the cables 54 are unfastened from the blocks 52 at the distal end of the base boom, shown in FIG. **2*b*, in order to permit removal of the cables 54. Thereafter, with reference to FIG. 3, the hydraulic lines to the block 110 are disconnected, and the pins are removed from the sleeves 114 of the block, freeing the piston-and-cylinder assembly 28 and the cables 54, 84 from the base boom 18** so that they, along with the intermediate and outer booms, can be pulled completely from the base boom. To re-assemble the outer boom section on the base boom, these steps are simply reversed. Thus, assembly and dis-assembly of the boom unit is greatly simplified, facilitating service, repair and replacement thereof.

Although the present invention has been described with reference to the preferred embodiment illustrated in the attached drawing figures, it is noted that substitutions may be made and equivalents employed herein without departing from the scope of the invention as recited in the claims.

What is claimed is:

1. In crane apparatus having an upstanding main frame, a turret carried by the main frame, and a three-section boom assembly including a base boom having two opposed walls, an intermediate second boom section telescopically received in the base boom and shiftable relative thereto, and an outer third boom section telescopically mounted in the intermediate boom and shiftable relative to the latter, the improvement comprising:

a piston and cylinder assembly mounted within the boom assembly and provided with a cylinder sleeve and a piston rod;

connector block means on the outermost end of the piston rod remote from the sleeve, hydraulic line means releaseably joined to the piston of the piston and cylinder assembly;

means defining opposed openings in the end of the base boom adjacent said turret;

removable pin means in said opposed openings of the walls of the base boom and received by said connector block means for releaseably coupling the piston and cylinder assembly to the base boom;

trunnion means for pivotally coupling the end of the sleeve of the piston and cylinder assembly adjacent said connector block means to the normally innermost end of the second boom section;

sheave means secured to the sleeve of the piston and cylinder assembly at the end thereof remote from said connector block means; and cable means joined to the connector block means, trained around the sheave on said sleeve of the piston and cylinder assembly, and coupled to the innermost end of the third boom section, whereby extension of the piston of the piston and cylinder assembly causes the second boom section to extend while the cable means causes concomitant extension of the third boom section and the second and third boom sections may be removed as a unit from the base boom by removal of the pin means from the base boom and uncoupling of the hydraulic line connections to the connector block means without disconnection of the extend cable means.

2. In crane apparatus as set forth in claim 1 wherein is provided second sheave means on the normally innermost end of the second boom section, and second cable means joined to the innermost end of the third boom section, trained around said second sheave means and connected to the base boom adjacent the outermost extremity thereof remote from said connector block means whereby upon retraction of the piston and cylinder assembly, the second boom section is retracted by the trunnion coupling of the sleeve of the piston and cylinder assembly to the second boom section and the third boom section is retracted by the connection of the second cable means between the second boom section and the base boom whereby upon removal of the pin means from the base boom and disconnection of the hydraulic means from the piston of the piston and cylinder assembly, the second and third boom sections may be removed from the base boom without the necessity of uncoupling of the second cable means from the second boom section and the base boom.

3. In crane apparatus as set forth in claim 1 wherein said connector block means is, a manifold for joining the hydraulic line means to the piston of the piston and cylinder assembly.

* * * * *